US006164342A

United States Patent [19]

De Jager et al.

[11] Patent Number: 6,164,342

[45] Date of Patent: Dec. 26, 2000

[54] METHOD AND APPARATUS FOR ADJUSTABLE WEFT THREAD INSERTION IN RAPIER WEAVING MACHINE

[75] Inventors: Godert De Jager, Volketswil; Frank Lehnert, Rüti; Paul Lincke, Kollbrunn, all of Switzerland

[73] Assignee: Sulzer Rüti AG, Rüti, Switzerland

[21] Appl. No.: 09/376,656

[22] Filed: Aug. 18, 1999

[30] Foreign Application Priority Data

Sep. 2, 1998 [EP] European Pat. Off. ..... 98810869

[51] Int. Cl.[7] ..... D03D 47/20; D03D 47/23

[52] U.S. Cl. ..... 139/448; 139/194

[58] Field of Search ..... 139/448, 446, 139/447, 194

[56] References Cited

U.S. PATENT DOCUMENTS

| | | | |
|---|---|---|---|
| 3,931,837 | 1/1976 | Volpe . | |
| 4,371,008 | 2/1983 | Freisler . | |
| 5,199,468 | 4/1993 | Aarts et al. | 139/439 |
| 5,476,122 | 12/1995 | Schuster et al. | 139/194 |

FOREIGN PATENT DOCUMENTS

| | | |
|---|---|---|
| 0509255A1 | 10/1992 | European Pat. Off. . |
| 0 651 082 | 5/1995 | European Pat. Off. . |
| 4101905A1 | 8/1991 | Germany . |
| 195 35 895C1 | 6/1996 | Germany . |
| 298 08 997 U1 | 9/1998 | Germany . |
| WO 97/40218 | 10/1997 | WIPO . |

*Primary Examiner*—Andy Falik
*Attorney, Agent, or Firm*—Townsend and Townsend and Crew LLP

[57] ABSTRACT

In the method a weft thread which is supplied via a thread brake and a thread presenter is inserted into a shed by means of rapiers with a thread clamp, with the thread clamp being set in a freely selectable manner for each weft insertion during the weft insertion. This makes it possible to insert weft yarns of different types and thickness into a shed. The system comprises a rapier (1) with a thread clamp (4) and an arrangement (4) with a first apparatus (11) for setting the thread clamp and with a second apparatus (21) for the actuation of the first apparatus.

15 Claims, 7 Drawing Sheets

A

METHOD AND APPARATUS FOR ADJUSTABLE WEFT THREAD INSERTION IN RAPIER WEAVING MACHINE

BACKGROUND OF THE INVENTION

The invention relates to a method for the insertion of a weft thread in a rapier weaving machine in accordance with the preamble of claim 1, to a system for carrying out the method and to a rapier weaving machine with a system of this kind.

An inserting rapier and a receiving rapier are used in rapier weaving machines for the insertion of the weft thread, with the weft thread transfer taking place approximately in the middle of the web width.

Each rapier is provided with a thread clamp.

In principle two kinds of thread clamps are used.

1. Positively "controlled thread clamps", with the thread receiving and releasing taking place via the corresponding thread clamp through closing and opening by means of an actuation means.

2. Negative or "automatically clamping thread clamps", with the thread receiving and releasing taking place through drawing of the thread into or out of the previously set clamping region respectively.

In a rapier weaving machine with a transfer of the weft thread in the middle of the fabric width the inserting rapier and the receiving rapier can each be equipped with similar thread clamps or with different thread clamps, i.e. negative, positive or a mixed form of clamp types.

If weft yarns of highly differing thickness or unequal smoothness are used for the manufacture of a certain cloth, an average clamping force or width of the clamping gap respectively is determined by experiments and the thread clamp is firmly set correspondingly. With the thus set thread clamp both a thick and a thin weft thread are inserted. The setting of the thread clamp is carried out predominantly in accordance with the thinner yarn in order that the latter does not slip out of the clamp during the weft insertion. A thicker yarn is accordingly mostly either squashed excessively or only insufficiently clamped with the same setting of the thread clamp and with substantially the same contour of the clamping body. The negative thread clamps have, in particular, the disadvantages that thread residues or fibrils respectively remain in the thread clamp of the inserting rapier when the weft thread is taken over by the receiving rapier, or that e.g. the thicker weft thread is already lost prior to it being taken over by the rapiers.

SUMMARY OF THE INVENTION

The object of the invention is to improve a method for the insertion of a weft thread.

The advantage which can be achieved with the invention is essentially to be seen in that the setting of the thread clamp takes place without losses in performance and in each case while the weaving machine is running.

An adjustable thread clamp for a rapier weaving machine is set forth. A rapier for movement along a path into and out of a shed in a weaving machine has a thread clamp on the rapier. The thread clamp has a stationary clamping part, a movable clamping part, and an adjustment element. The adjustment element has an orientation on the clamping parts for adjustably urging the clamping parts one towards another. A fixed adjusting member outside the shed of the weaving machine is in the path of rapier movement out of the shed of the weaving machine. This fixed adjusting member has adjusting contact with the adjustable member to change the orientation of the adjustment element on the clamping parts during rapier movement. Changed clamping of the thread occurs during the dynamics of rapier insertion and withdrawal during weaving. A corresponding method is disclosed.

Advantageous embodiments result from the subordinate patent claims.

The invention will be described in the following with reference to the accompanying drawings, with similar features being designated by the same reference numeral.

DESCRIPTION OF THE DRAWINGS

Shown are.

DESCRIPTION OF THE PREFERRED EMBODIMENTS

Figures 1, 2, 3:
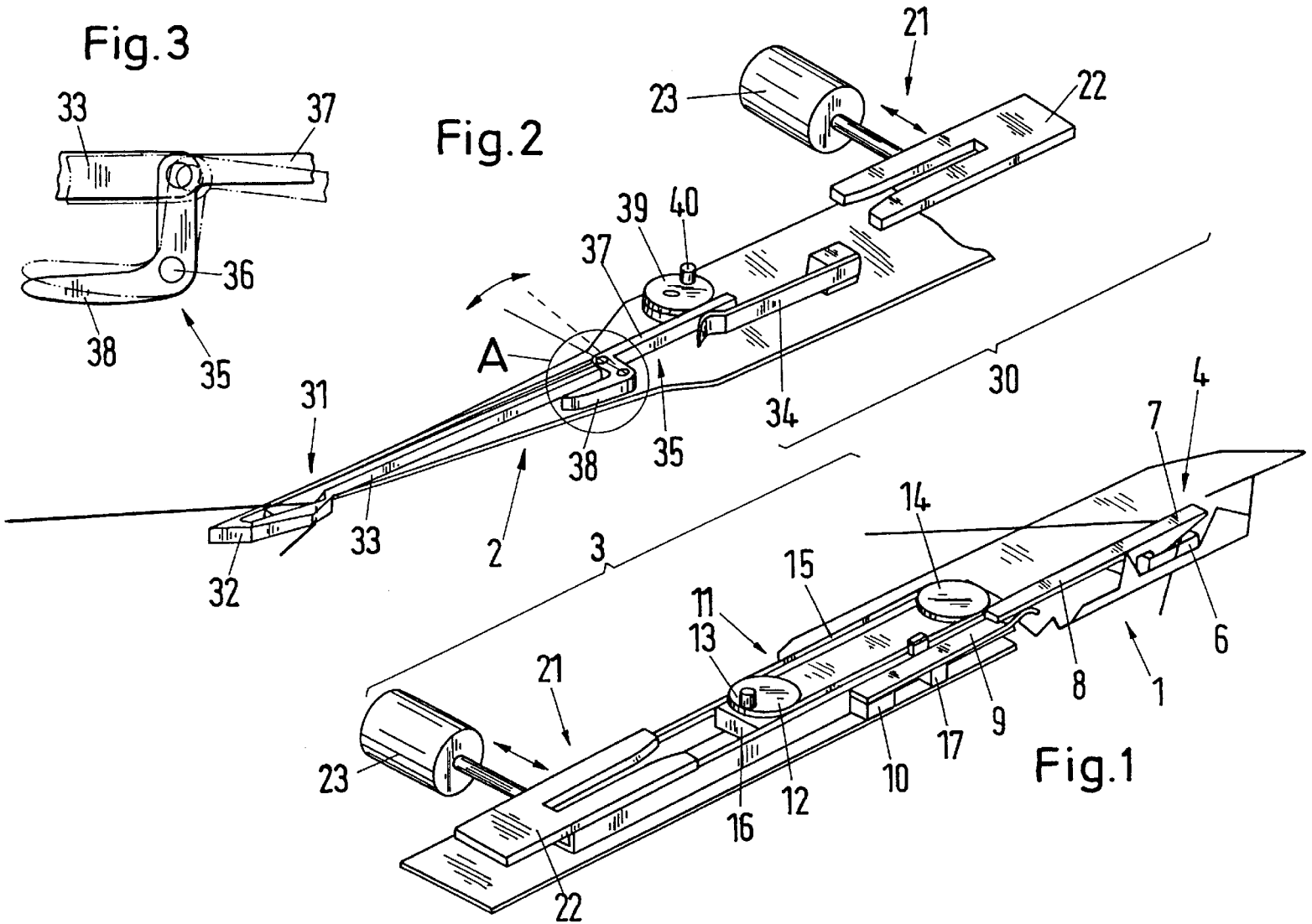
FIG. 1 a first embodiment of a system in accordance with the invention with an inserting rapier in a three-dimensional illustration.
FIG. 2 the first embodiment of the system in accordance with the invention with a receiving rapier in a three-dimensional illustration.
FIG. 3 a detail A in FIG. 1 in the plan view.

As FIG. 1 shows, the system has an inserting rapier 1 with a thread clamp 4 and an arrangement 3 for the setting of the clamping force. The thread clamp 4 comprises a first clamping part 6, which is secured to the housing of the rapier 1, a second clamping part 7 with an extension 8, which is mounted at the housing of the rapier 1 and a leaf spring 9 which is secured at the housing of the rapier 1, by means of a holder 10 in cantilever manner such that the free spring end lies in contact with the lower side of the extension 8 with a certain bias force.

The arrangement 3 comprises a first apparatus 11 for the setting of the clamping force, which is arranged at the housing of the rapier, and a second apparatus 21 of fixed position for the actuation of the first apparatus.

The first apparatus 11 contains a drive disc 12 with a pin 13, a deflection disc 14 and, a kinematic member 15 which is guided over the discs 12, 14 and comprises a braking part 16 in which the discs are journalled for rotary movement in such a manner that a resistance is present between the discs and the braking part. A setting member 17 is fastened at the kinematic member in such a manner that it engages beneath the leaf spring 9. The second apparatus 21 contains a sliding guide 22 and an electrical drive 23 of fixed position for the adjustment of the sliding guide. The sliding guide 22 is open at one end and is preferably formed in the shape of a funnel.

As shown in FIGS. 2 and 3, the system has a receiving rapier 2 with a thread clamp 31 and an arrangement 30 for the setting of the width of the clamping gap of the thread clamp. The thread clamp comprises a hook-shaped clamping part 32, which is formed in a single piece with the housing of the rapier 2, a clamping tongue 33, which cooperates with the clamping part, and a leaf spring 34. The clamping tongue 33 is pivotally connected to a two-armed lever 35. The lever 35 is journalled at a pin 36, which is secured at the housing of the receiving rapier 2 (FIG. 3). The lever 35 is arranged and designed in such a manner that the one lever arm 37 lies in contact at the leaf spring 34 and the other lever arm 38 can be brought into engagement with a non-illustrated device for the opening of the thread clamp which is known per se.

The arrangement 30 has a first apparatus which contains an eccentric part 39 which is journalled in a brake part and a pin 40, which is arranged at the eccentric part in order to actuate the clamping tongue, and a second apparatus 21.

Figure 4:
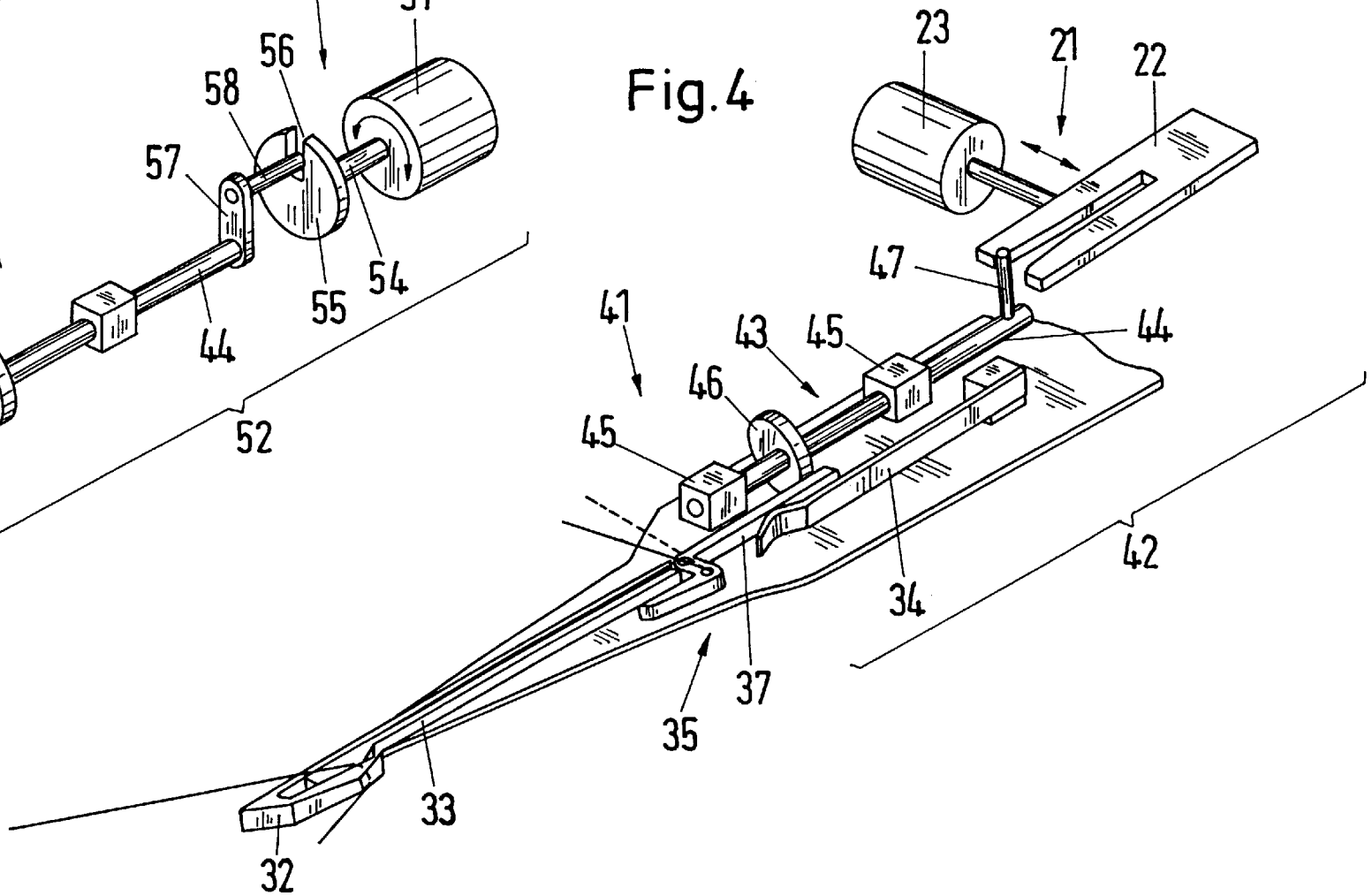
FIG. 4 a second embodiment of a system in accordance with the invention with a receiving rapier in a three-dimensional illustration.

FIG. 4 shows a receiving rapier 41 with a second embodiment of an arrangement 42 which contains a first apparatus 43 for the setting of the width of the clamping gap and the second apparatus 21. The first apparatus 43 contains a shaft 44, two bearing parts 45 which are secured at the housing of the receiving rapier 41, an eccentric part 46 which is arranged on the shaft 44 and lies in contact at the lever 37 and a pin 47 which is secured to the shaft 44 and can be brought into and out of engagement with the sliding guide 22.

Figure 5:
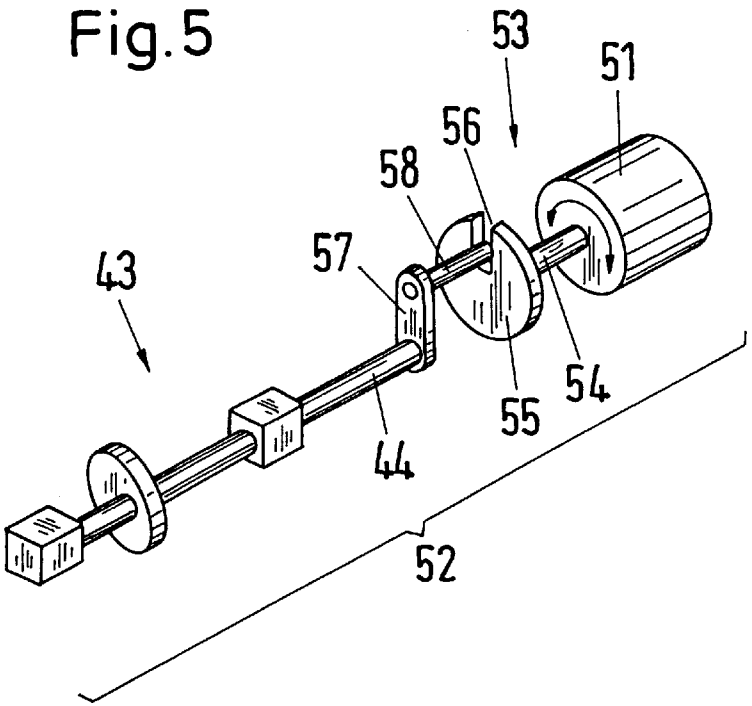
FIG. 5 a modified embodiment of the arrangement in accordance with FIG. 4 in a three-dimensional illustration.

FIG. 5 shows a modified arrangement 52 with the first apparatus 43 (FIG. 4) and with a second apparatus 53. The second apparatus contains a drive motor 51 and a disc 55 which is secured on the motor shaft 54. The disc 55 is provided with a slit 56. A lever 57 with a pin 58 is provided at the shaft 44 of the first apparatus and can be brought into and out of engagement with the slit 56. For this the slit has a run-in section.

Figure 6:
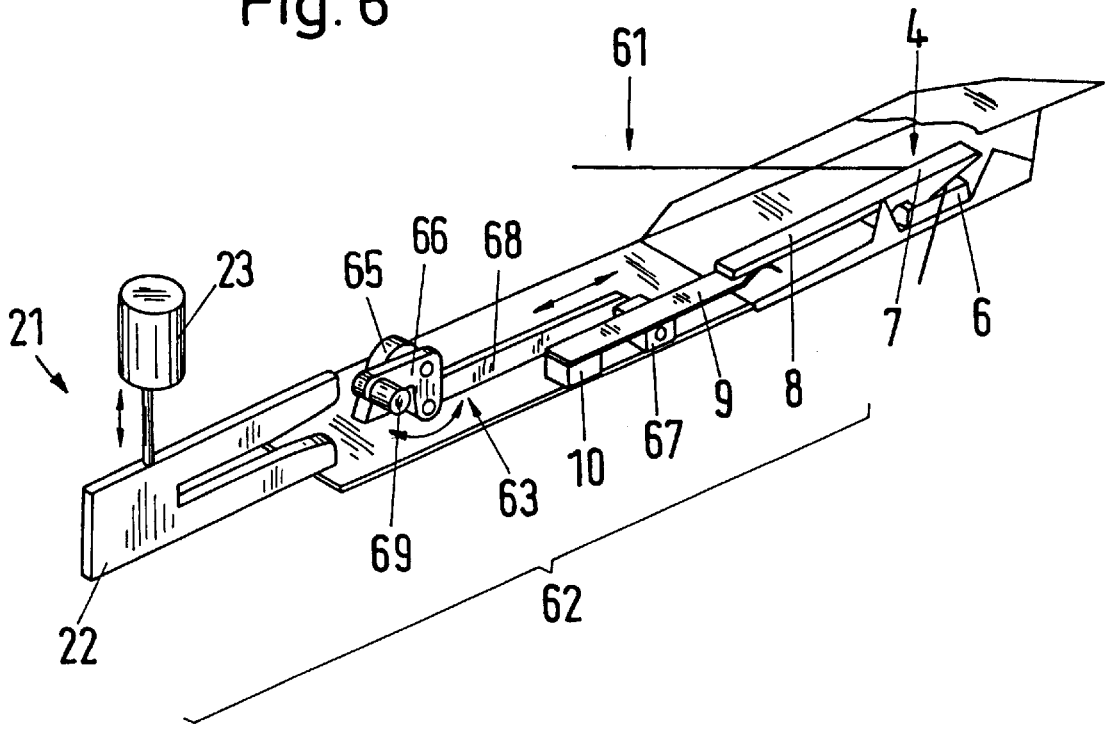
FIG. 6 a third embodiment of a system in accordance with the invention with an inserting rapier in a three-dimensional illustration.

FIG. 6 shows an inserting rapier 61 with the thread clamp 4 and with an arrangement 62 which comprises a first apparatus 63 for the setting of the clamping force and the second apparatus 21 for the actuation of the first apparatus 63. The first apparatus 63 has a bearing block 65 which is secured at the housing of the inserting rapier 61, a cranked lever 66 which is pivotally journalled at the bearing block, a setting member 67 which engages beneath the leaf spring 9, a lever 68 which is rotationally movably connected at one end to the cranked lever and at the other end to the setting member and a pin 69 which can come into and out of engagement with the sliding guide 22.

Figure 7:
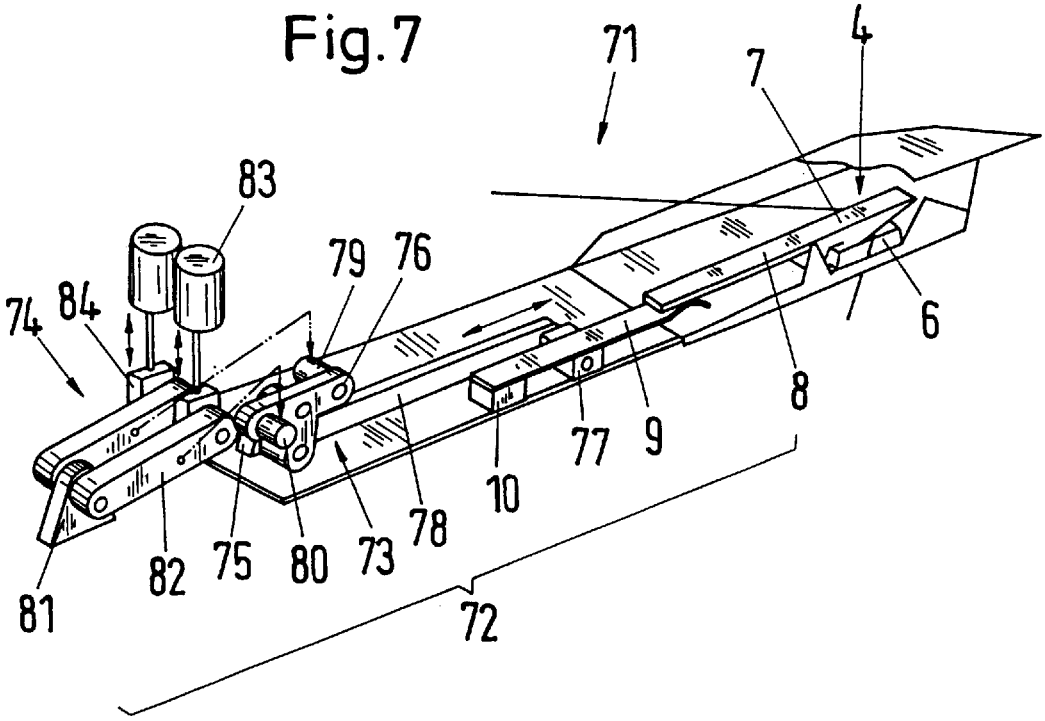
FIG. 7 a modified third embodiment of the system with an inserting rapier in a spatial illustration.

FIG. 7 shows an inserting rapier 71 with the thread clamp 4 and with an arrangement 72 which comprises a first apparatus 73 for the setting of the clamping force and a second apparatus 74 for the actuation of the first apparatus 73. The first apparatus 73 has a bearing block 75 which is secured to the housing of the inserting rapier 71, a T-shaped lever 76 which is pivotally journalled at the bearing block, a setting member 77 which engages beneath the leaf spring 9, a lever 78 which is movably connected at the one end to the lever 76 and at the other end to the setting member and a first and a second pin 79, 80 which can come into and out of engagement with the second apparatus 74. The second apparatus 74 has a bearing block 81 which is arranged at a fixed position, two levers 82 which are pivotally connected to the bearing block and two electrical drives 83 which are in each case connected to a lever 82 via connecting members 84 in order to actuate the first apparatus through pivoting of the levers.

Figure 8:
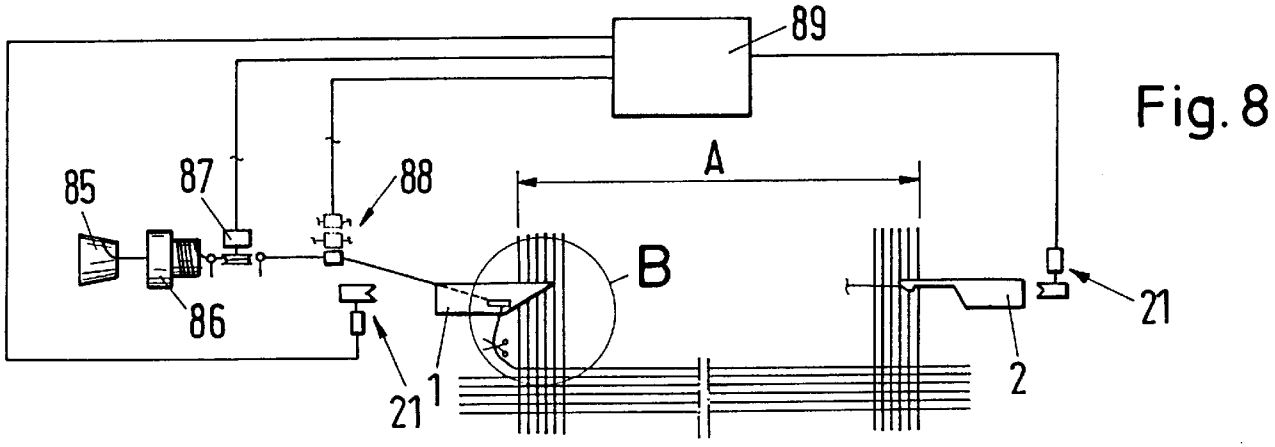
FIG. 8 a schematic illustration of a device for the insertion of a weft thread for a rapier weaving machine with the systems.
Figure 9:
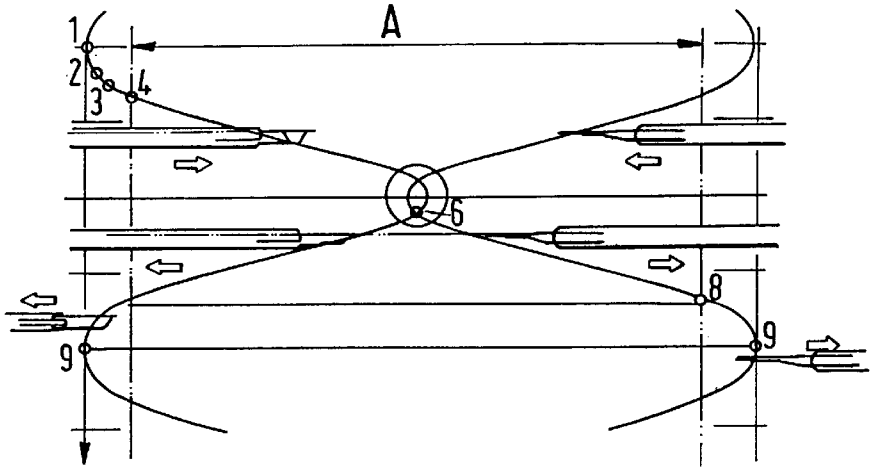
FIG. 9 a diagram of the rapier movement.

In the following the method for the insertion of a weft thread with the inclusion of the systems which were explained in reference to FIGS. 1 to 3 will be explained. FIG. 8 shows the elements which are at least required for the preparation of a weft thread to be inserted, and indeed a thread supply 85, a thread store 86, a thread brake 87, a thread presenter 88 and a control unit 89 as well as the systems with the inserting rapier 1 or the receiving rapier 2 respectively, the plot of the movements of which can be seen in FIG. 9. As is shown in FIG. 8 the weft thread is introduced into a shed from the left side of the weaving machine by the inserting rapier 1 and is taken over by the receiving rapier 2 in the middle of the fabric width A and drawn out of the shed. The plot of the movements is sinusoidal, i.e. each rapier 1, 2 executes a back and forth movement within a rotational angle of 360°, with the reversal of the movement arising in each case at 0°, 180° and 360° with a standstill. The weaving machine is arranged in such a manner, in dependence on the fabric width, that a section of the plot of the movement of the rapiers lies outside the cloth width, which is composed of symmetrical backward and forward sections. During the forward movement a weft thread to be inserted is placed in a known manner into the path of movement of the inserting rapier 1 by the thread presenter 88, is gripped by the thread clamp and is severed directly prior to its entry into the cloth width, or is taken over from a receiver which holds the start of the thread which has already been previously severed. The clamping force of the thread clamp of the inserting rapier can be set anew as required during the return movement, during the quasi standstill and during the forward movement section up to the time at which the weft thread is engaged by the thread clamp. For this a signal is produced in the control unit 89 on the basis of a measured parameter determined during the travel of the weft thread, e.g. of the thread tension or of the yarn type and/or of the yarn thickness of the weft thread to be inserted.

The new setting takes place as a result of this signal from the control unit 89 and when the pin 13 is located in the sliding guide 22. The sliding guide can also already be preset prior to the entry of the pin 13 so that the pin automatically moves into a new position via the funnel-shaped run-in. Through the displacement of the connecting member 22 the drive disc 12 is rotated and the setting member 17 is displaced via the kinematic member 15 along the leaf spring 9 so that the spring characteristic is changed and the clamping force is set anew. As already mentioned, the receiving rapier 2 takes over the weft thread from the inserting rapier 1. For this the thread clamp has a wedge-shaped clamping gap into which the weft thread is drawn by the receiving rapier, which is engaged in the return movement. For the setting of the width of the clamping gap the eccentric part 39 is adjusted by means of the second apparatus 21 via the pin 40. Through this the two-armed lever 35 is pivoted and the clamping tongue 33 is drawn back, as is illustrated in FIG. 3.

Figure 10:
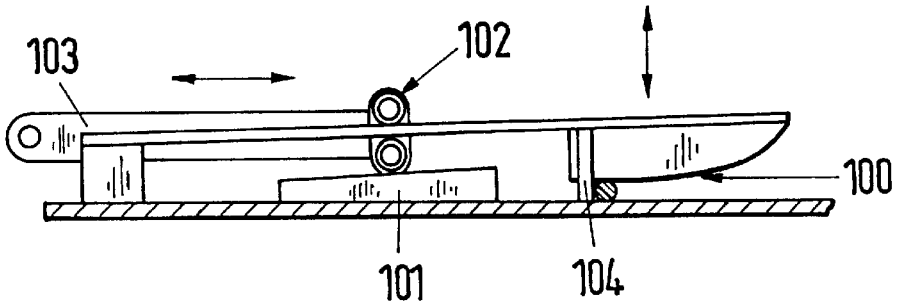
FIG. 10 an embodiment of a setting member for the variation of the clamping force and the width of the clamping gap of a thread clamp.

FIG. 10 shows a thread clamp with a clamping gap 100. An arrangement which is illustrated in FIG. 10 is provided for the setting of the clamping force and also of the width of the clamping gap. The arrangement contains a wedge-shaped support part 101 which is secured, e.g. longitudinally displaceably secured, at the housing of a rapier, a guide part, e.g. in the form of a roller arrangement 102, which lies on the support part 101 and is in engagement with the leaf spring of a thread clamp, and a lever 103 which carries the roller arrangement and is connected to a non-illustrated actuation apparatus. Furthermore, the thread clamp is provided with an abutment member 104 in order to hold the weft thread in the clamping gap 100.

Figure 11:
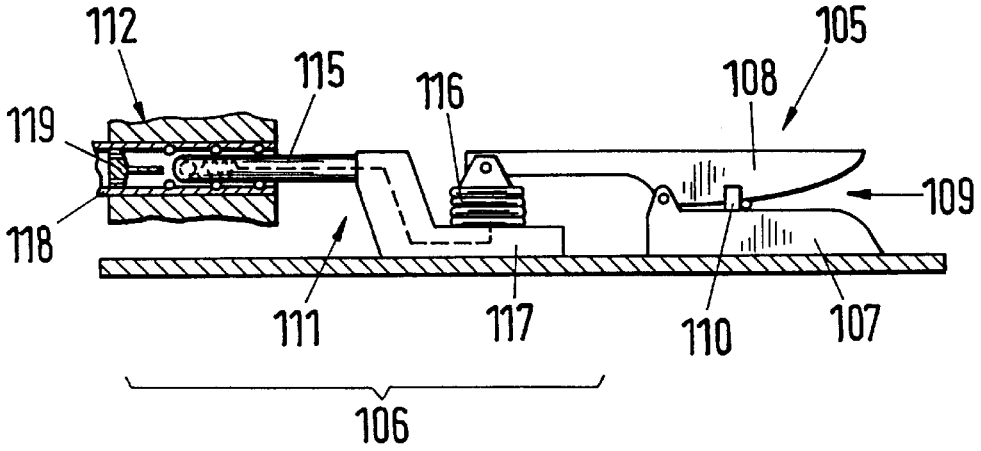
FIG. 11 a fourth embodiment of a system in accordance with the invention.
Figure 12:
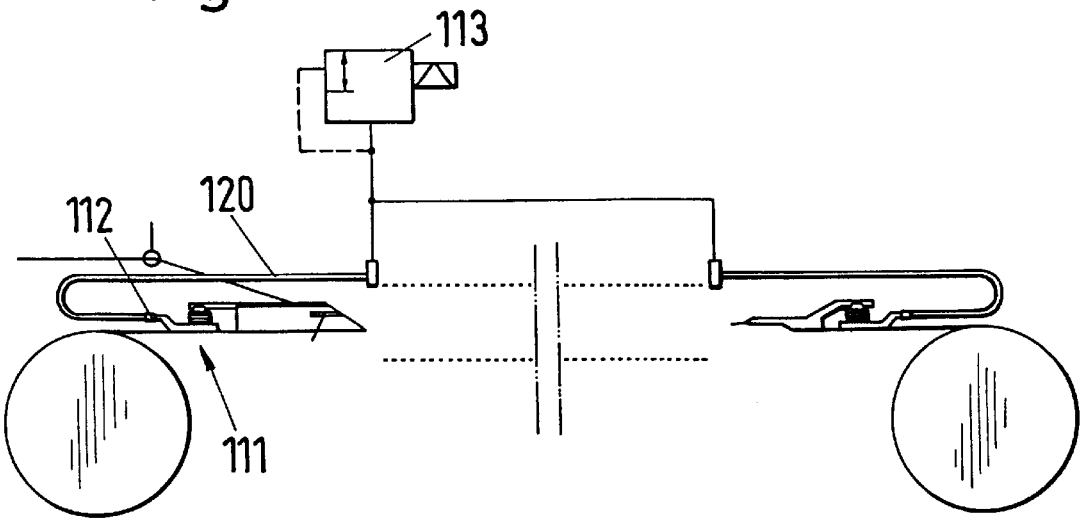
FIG. 12 a schematic illustration of a device for the insertion of weft threads.

Reference is made to FIGS. 11 and 12. FIG. 11 shows a system in which the setting of the thread clamp takes place in a pneumatic manner and which is used in the inserting rapier and in the receiving rapier. The system contains a rapier with a thread clamp 105 in order to clamp a weft thread and an arrangement 106 for the setting of the thread clamp. The thread clamp has a first clamping part 107, a second clamping part 108 having an extension and being pivotally connected to the first clamping part 107, so that a gap 109 is present as well as an abutment member 110 in order to prevent the weft thread being pulled through the gap. The arrangement 106 comprises a first apparatus 111 for the setting of the clamping force and a second apparatus 112 for the actuation of the first apparatus. The first apparatus contains a valve 115, a bellows 116 which is connected to the second clamping part 108 and a line 117 in order to connect the bellows to the valve. The second apparatus 1 12 contains a receiving part 118 which is provided with seals, which is arranged in a fixed position in the path of travel of the rapier and which can be brought into and out of engagement with the valve, and a pin 119 for the opening of the valve.

As FIG. 12 shows, the second apparatus 112 is connected in each case via hoses 120 to a regulating valve 113 which is controlled by the control unit 89 (FIG. 8) in order to set the clamping force. Another possibility consists in connecting the hose 120 directly to the bellows 116 so that the first apparatus 111 can be omitted.

Figure 13:
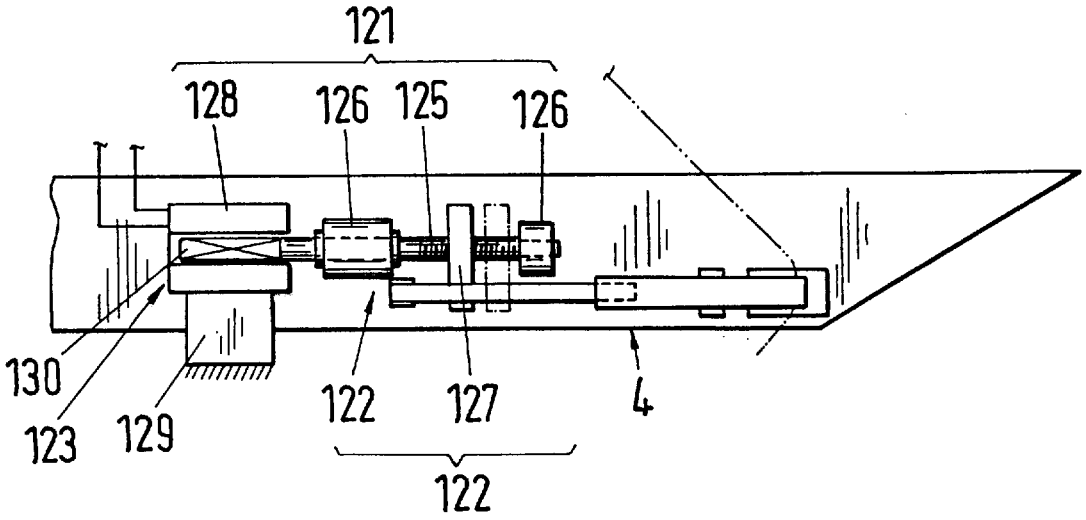
FIG. 13 a fifth embodiment of a system in accordance with the invention with an inserting rapier.

FIG. 13 shows an embodiment of the system in which the setting of the thread clamp takes place by a direct electrical route. As shown in FIG. 13, the system with the inserting rapier has a thread clamp 4, which is designed the same as the thread clamp in accordance with FIG. 1, and an arrangement 121. The arrangement has a first apparatus 122 for the setting of the clamping force of the thread clamp and a second apparatus 123 for the actuation of the first apparatus 122. The apparatus for the setting of the clamping force is mounted at the housing of the rapier and contains a spindle with a thread 125 at one end, two bearing blocks 126 for the spindle and a setting member 127 which is screwed onto the threaded spindle and which engages beneath the leaf spring of the thread clamp. The apparatus 123 for the actuation of the apparatus 122 for the setting of the clamping force contains an electric drive, the stationary part 128 of which is fastened to a holder 129 so that the latter is of fixed position. The rotating part 130 of the drive is designed as an end section of the spindle. As has already been mentioned the clamping force of the thread clamp can, when required, be set anew during the return movement, i.e. when the rotating part 130 of the spindle is in engagement with the stationary part 128. The threaded spindle is driven by the drive 123 so that the setting member 127 is displaced along the leaf spring in order to change the spring characteristic. Instead of the above named and illustrated direct electric drive, a geared motor can also be used in order to actuate the threaded spindle via a transmission. Possibly restricted space conditions are thereby taken into account.

Figure 14:
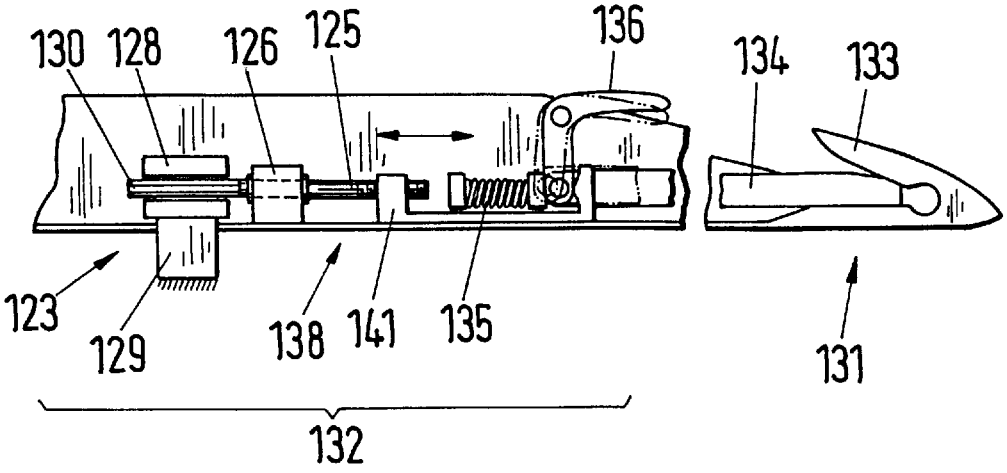
FIG. 14 a fifth embodiment of a system in accordance with the invention with a receiving rapier.

FIG. 14 shows an embodiment of the system in which the setting of the width of the clamping gap takes place in an electrical manner. As shown in FIG. 14 the system with the receiving rapier has a thread clamp 131 and an arrangement 132. The thread clamp has a hook-shaped clamping part 133 which is formed in a single piece with the housing of the rapier, a movable clamping tongue 134 which can be brought into and out of engagement with the hook-shaped clamping part, a spring 135 in order to hold the thread clamp in the clamping position and a lever 136 in order to open the thread clamp against the force of the spring. The arrangement 132 comprises a first apparatus 138 for the setting of the width of the clamping gap of the thread clamp and the second apparatus 123 for the actuation of the first apparatus 138. The first apparatus is mounted at the housing of the rapier and contains a spindle 125 with a thread at one end, a bearing block 126 for the spindle and a U-shaped member 141 which is screwed onto the threaded spindle and is in communication with the movable clamping tongue 134. The second apparatus 123 is designed similarly to that in FIG. 13 and will thus not be described. As already mentioned the width of the clamping gap of the thread clamp is set anew when required during the return movement, that is when the rotating part 130 of the spindle is in engagement with the stationary part 128 of the drive. The threaded spindle is driven by the drive 123 so that the U-shaped member 141 moves along the spindle and thereby displaces the movable clamping tongue relative to the hook so that the width of the gap is varied.

Figure 15:
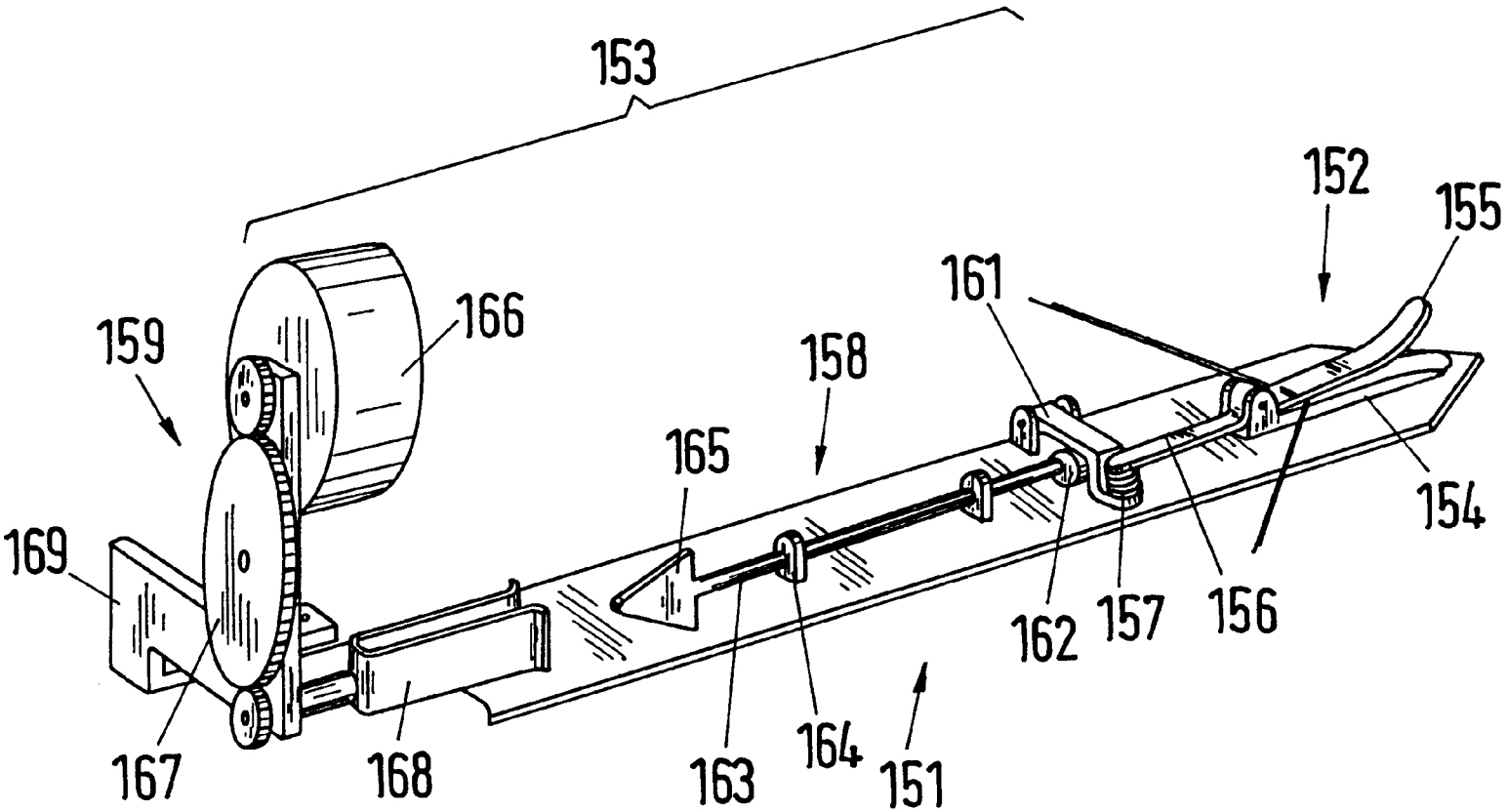
FIG. 15 a sixth embodiment of a system in accordance with the invention with an inserting rapier.

As shown in FIG. 15 the system has an inserting rapier, 151 with a thread clamp 152 and an arrangement 153 for the setting of the clamping force. The thread clamp comprises a first clamping part 154 which is secured to the housing of the rapier 151, a second clamping part 155 with an extension 156 which is journalled at the first clamping part 154 and a coil spring 157.

The arrangement 153 comprises a first apparatus 158 for the setting of the clamping force, which is arranged at the housing of the rapier and a second apparatus 159 for the actuation of the first apparatus, which is of fixed position.

The first apparatus 158 contains a setting lever 161 which is journalled at the housing of the rapier 151 and carries the spring 157, an eccentric part 162 which is in contact with the setting lever 161 and an axle 163 which is journalled in bearing blocks 164. The eccentric part is secured at one end of the axle. The axle has a section 165 which can be brought into and out of engagement with the second apparatus 159.

The second apparatus 159 contains a drive 166, a transmission 167 and a setting member 168 which are respectively mounted and journalled at a carrier 169.

This system has the same function as the above described systems and will therefore not be described in detail.

In the method a weft thread which is supplied via a thread brake and a thread presenter is inserted into a shed by means of rapiers with a thread clamp, with the thread clamp being set in a freely selectable manner for each weft insertion during the process of the insertion of the weft thread. This makes it possible to insert weft yarns of different types and thicknesses into a shed.

The system comprises a rapier 1 with a thread clamp 4 and an arrangement 4 with a first apparatus 11 for setting the thread clamp and with a second apparatus 21 for the actuation of the first apparatus.

What is claimed is:

1. A method for the insertion of a weft thread in a rapier weaving machine comprising the steps of:

providing a rapier for movement along a path into and out of a shed in a weaving machine;

providing a thread clamp on the rapier having a stationary clamping part, a movable clamping part, and an adjustment element having a orientation on the clamping parts for urging the clamping parts one towards another;

providing an adjustable member on the rapier in contact with the adjustment element for changing the orientation of the adjustment element to adjustably urge the clamping parts towards one another;

providing a fixed adjusting member outside the shed of the weaving machine in the path of rapier movement for adjusting contact with the adjustable member during rapier movement along the path to change the orientation of the adjustment element on the clamping parts during rapier movement; and moving the rapier out of the shed in the weaving machine with the adjustable member on the rapier in adjusting contact with the fixed adjusting member to correspondingly change the orientation of the adjustment element on the clamping parts during rapier movement.

2. A method for the insertion of a weft thread in a rapier weaving machine according to claim 1 wherein the step of:

providing an adjustable member on the rapier in contact with the adjustment element for changing the orientation of the adjustment element includes:

changing the clamping force of the clamping members.

3. A method for the insertion of a weft thread in a rapier weaving machine according to claim 1 wherein the step of:

providing an adjustable member on the rapier in contact with the adjustment element changing the orientation of the adjustment element includes:

changing the clamping gap of the clamping members.

4. A method for the insertion of a weft thread in a rapier weaving machine according to claim 1 comprising:

adjusting the fixed adjusting member in dependence upon the thread tension of the weft thread.

5. A method for the insertion of a weft thread in a rapier weaving machine according to claim 1 comprising:

adjusting the fixed adjusting member in dependence upon yarn of the weft thread.

6. A method for the insertion of a weft thread in a rapier weaving machine according to claim 5 comprising:

adjusting the fixed adjusting member in dependence upon the yarn thickness of the weft thread.

7. An adjustable thread clamp for a rapier type weaving machine comprising:

a rapier for movement along a path into and out of a shed in a weaving machine;

a thread clamp on the rapier having a stationary clamping part, a movable clamping part, and an adjustment element having a orientation on the clamping parts for adjustably urging the clamping parts one towards another;

an adjustable member on the rapier in contact with the adjustment element for changing the orientation of the adjustment element to adjustably urge the clamping parts towards one another; and a fixed adjusting member outside the shed of the weaving machine in the path of rapier movement out of the shed of the weaving machine for adjusting contact with the adjustable member to change the orientation of the adjustment element on the clamping parts during rapier movement.

8. An adjustable thread clamp for a rapier type weaving machine according to claim 7 comprising:

the adjustable member on the rapier in contact with the adjustment element for changing the orientation of the adjustment element adjustably urges the clamping parts towards one another to change the width of the clamping gap.

9. An adjustable thread clamp for a rapier type weaving machine according to claim 7 wherein:

the fixed adjusting member outside the shed of the weaving machine in the path of the rapier includes at least one setting element and a drive for moving the setting element.

10. An adjustable thread clamp for a rapier type weaving machine according to claim 9 wherein:

the drive includes a geared motor.

11. An adjustable thread clamp for a rapier type weaving machine according to claim 7 wherein:

the adjustment element having an orientation on the clamping parts includes a bellows.

12. An adjustable thread clamp for a rapier type weaving machine according to claim 7 wherein:

the adjustable member on the rapier includes a thread on a shaft with a setting member; and the fixed adjusting member outside the shed of the weaving machine includes an electric drive with a stator and a rotor.

13. An adjustable thread clamp for a rapier type weaving machine according to claim 7 wherein:

the adjustable member on the rapier is in contact with a spring member to set the clamping force and the clamping gap.

14. An adjustable thread clamp for a rapier type weaving machine according to claim 7 wherein:

the rapier is adapted to be used as an inserting rapier.

15. An adjustable thread clamp for a rapier type weaving machine according to claim 7 wherein:

the rapier is adapted to be used as a receiving rapier.

* * * * *